US005154104A

United States Patent [19]

O

[11] Patent Number: 5,154,104

[45] Date of Patent: Oct. 13, 1992

[54] TOOL FOR INSTALLING CEILING-MOUNTED ELEMENTS

[76] Inventor: Sangkil O, 993 S. Wilton Pl., Los Angeles, Calif. 90019

[21] Appl. No.: 757,945

[22] Filed: Sep. 12, 1991

[51] Int. Cl.[5] ..... B25G 1/04; B25G 1/06

[52] U.S. Cl. ..... 81/177.2; 81/177.4

[58] Field of Search ..... 81/177.1, 177.2, 177.6, 81/437, 459, 460, 461; 220/8; 285/298; 362/418; 403/109

[56] References Cited

U.S. PATENT DOCUMENTS

| | | | |
|---|---|---|---|
| 854,742 | 5/1907 | Hill | 81/177.2 |
| 4,075,913 | 2/1978 | Tye | 81/177.75 |
| 4,350,064 | 9/1982 | Markle . | |
| 4,352,307 | 10/1982 | Martinmaas | 81/177.4 |
| 4,766,783 | 8/1988 | Stanich . | |
| 4,882,958 | 11/1989 | McNeeley | 81/177.2 |
| 5,033,337 | 7/1991 | Thomas | 81/177.2 |

*Primary Examiner*—Frank T. Yost
*Assistant Examiner*—Paul M. Heyrana
*Attorney, Agent, or Firm*—Terry M. Gernstein

[57] ABSTRACT

A tool that permits a worker located on a building floor to install elements in a high ceiling includes a telescoping housing section that is attached to a hand-held power tool, such as a power drill or the like, and a threaded rod threadably engaged with the housing section. A rod coupling element is threadably engaged with the rod, and couples the ceiling-mounted element to the tool. The tool is extendable to accommodate ceilings of various heights, and can include a stepped surface so other hand-held tools can be used to apply torque thereto.

12 Claims, 8 Drawing Sheets

TOOL FOR INSTALLING CEILING-MOUNTED ELEMENTS

TECHNICAL FIELD OF THE INVENTION

The present invention relates to the general art of hand tools, and to the particular field of hand tool adapters.

BACKGROUND OF THE INVENTION

Many buildings, especially commercial buildings, may have high ceilings that can be more than ten feet above floor level. As many building elements and fixtures, such as electrical boxes, ceiling tiles, pipes, HVAC conduits, electrical fixtures and the like, are suspended from a building ceiling, mounting such elements can be difficult, time consuming and expensive. Installing such elements may require two, or more, workers, and may require special scaffolding as well. Not only will the time consumed in actually installing the elements be extensive, setting up and knocking down the scaffolding may be costly as well. Still further, any time workers must work in an elevated location, an element of danger is introduced into the procedure. This element of danger can be costly in time and insurance. This is especially true if some or all of the ceiling elements must be mounted in difficult-to-reach places.

Therefore, there is a need for a tool that can be used to install ceiling-mounted elements without requiring the worker to leave the floor and which will enable one worker, working alone, to install most ceiling-mounted elements.

Still further, since not all ceilings are the same height, there is a need for a tool for installing ceiling-mounted elements that can accommodate ceilings of various heights. Even further to this, different workers have different preferences for tools. Therefore, there is a need for a tool that can be used with a variety of hand and power tools to install elements in a building ceiling.

OBJECTS OF THE INVENTION

It is a main object of the present invention to provide a tool for installing ceiling-mounted elements that will enable a worker to remain on the ground while carrying out the procedure of attaching a ceiling-mounted element to a high ceiling.

It is another object of the present invention to provide a tool for installing ceiling-mounted elements that will enable a worker to carry out the procedure while working alone.

It is another object of the present invention to provide a tool for installing ceiling-mounted elements that is easily adjusted to accommodate ceilings of various heights.

It is another object of the present invention to provide a tool for installing ceiling-mounted elements that is amenable to use with a variety of hand and power tools.

SUMMARY OF THE INVENTION

These, and other, objects are achieved by a tool for installing ceiling-mounted elements which includes a telescoping housing section having a hand or power tool engaging shank fixed at one end and a rod coupling element on another end thereof. The housing rotates with the hand or power tool engaging shank when that shank is engaged with a hand-held power tool, such as a hand drill or the like.

An externally threaded rod is threadably coupled to the rod coupling and to the housing. The housing includes two telescoping sections that are coupled together using set screws or other such fasteners. The housing sections are positioned relative to each other according to the height of the ceiling, and the threaded rod is adjusted so the ceiling-mountable element extends beyond the distal end of the tool in position to be drivingly inserted into the ceiling when the hand held power tool is operated.

In this manner, one worker, working alone, can remain on the floor of a building and still insert ceiling-mounted elements, such as hangers, or the like, into a high ceiling. Even if the ceiling-mounted element is to be located in a hard-to-reach spot, the tool of the present invention can be used to carry out the procedure without endangering the worker by requiring him or her to stand on a scaffold in an awkward position. The telescoping housing sections, the threaded rod and the rod coupling element are all moved relative to each other to adjust the length of the tool to accommodate ceilings of various heights.

Still further, the tool can have additional elements for connection to various other hand held tools, such as wrenches, or the like. This provides further versatility to the tool.

BRIEF DESCRIPTION OF THE DRAWING FIGURES

DETAILED DESCRIPTION OF THE PREFERRED EMBODIMENT OF THE INVENTION

Figure 1:
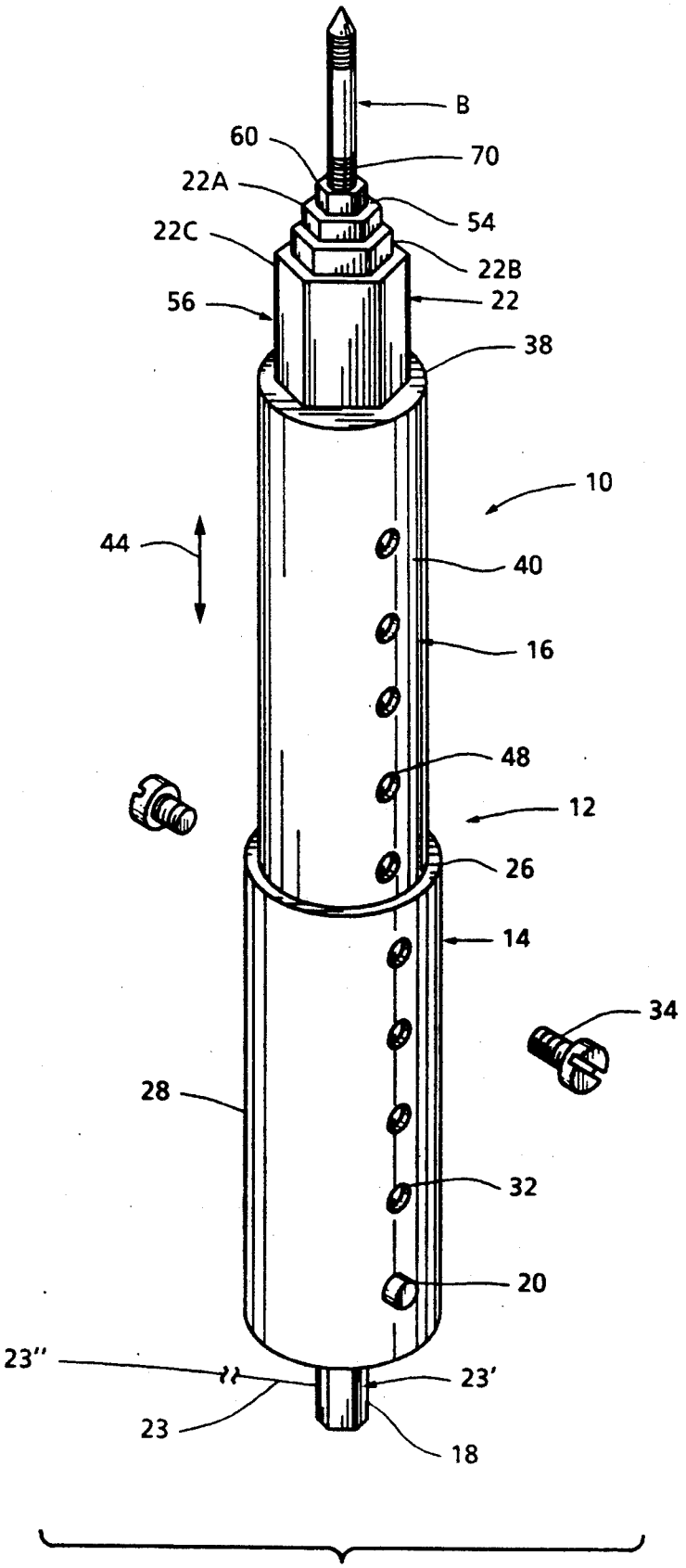
FIG. 1 is a perspective view of the tool for installing ceiling-mounted elements embodying the present invention.
Figure 2:
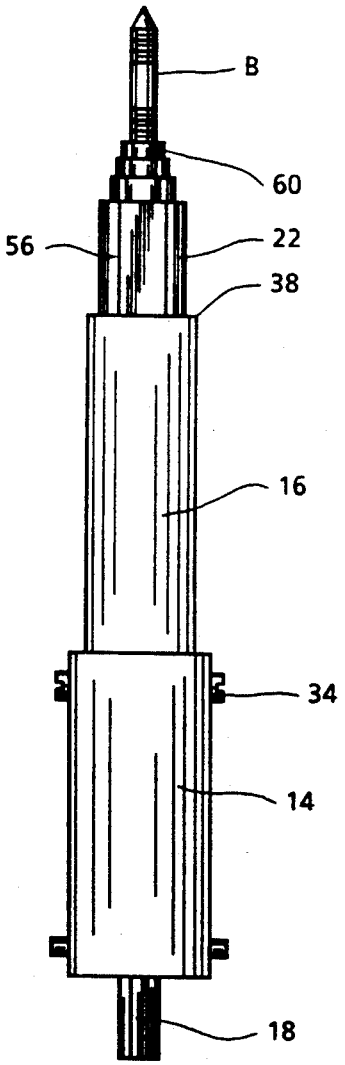
FIG. 2 is a front elevational view thereof.
Figure 3:
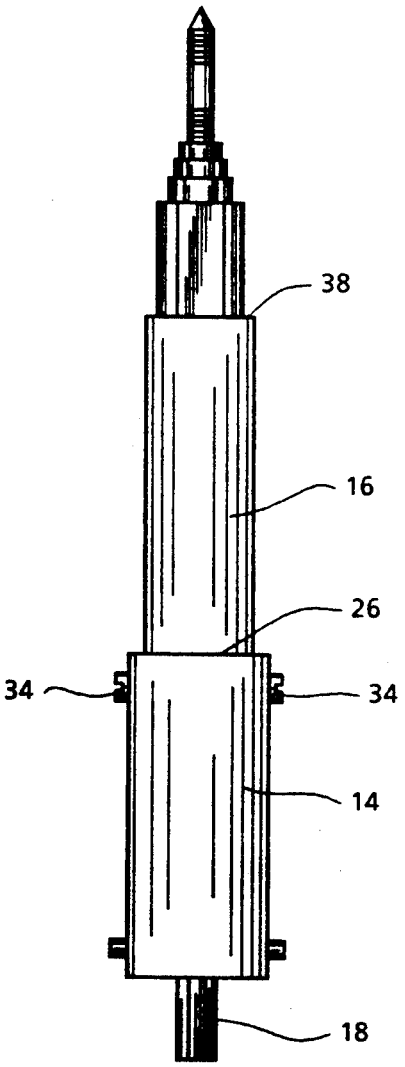
FIG. 3 is a front elevational view thereof.
Figure 4:
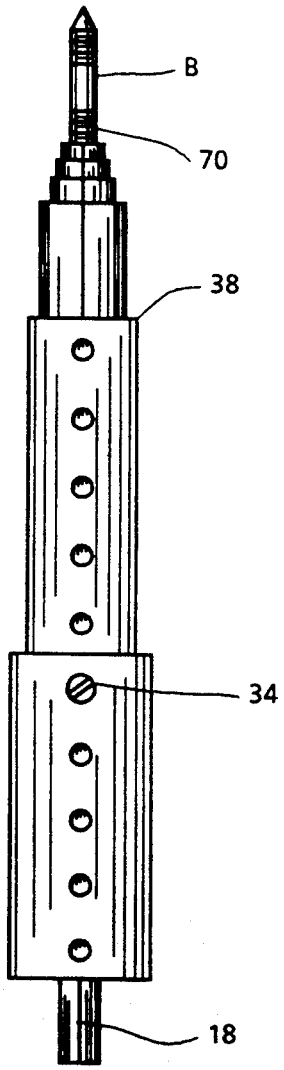
FIG. 4 is a side elevational view thereof.
Figure 5:
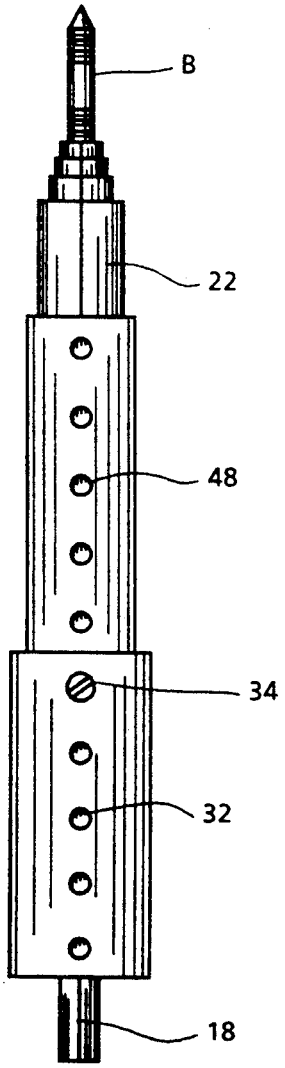
FIG. 5 is a side elevational view thereof.
Figure 6:
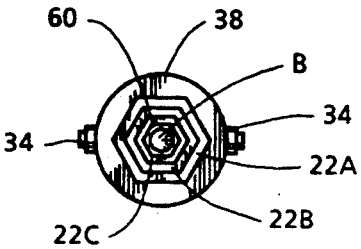
FIG. 6 is a top view thereof.
Figure 7:
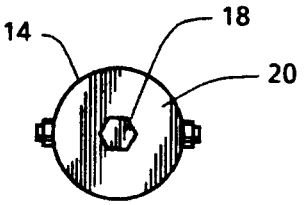
FIG. 7 is a bottom view thereof.
Figure 8:
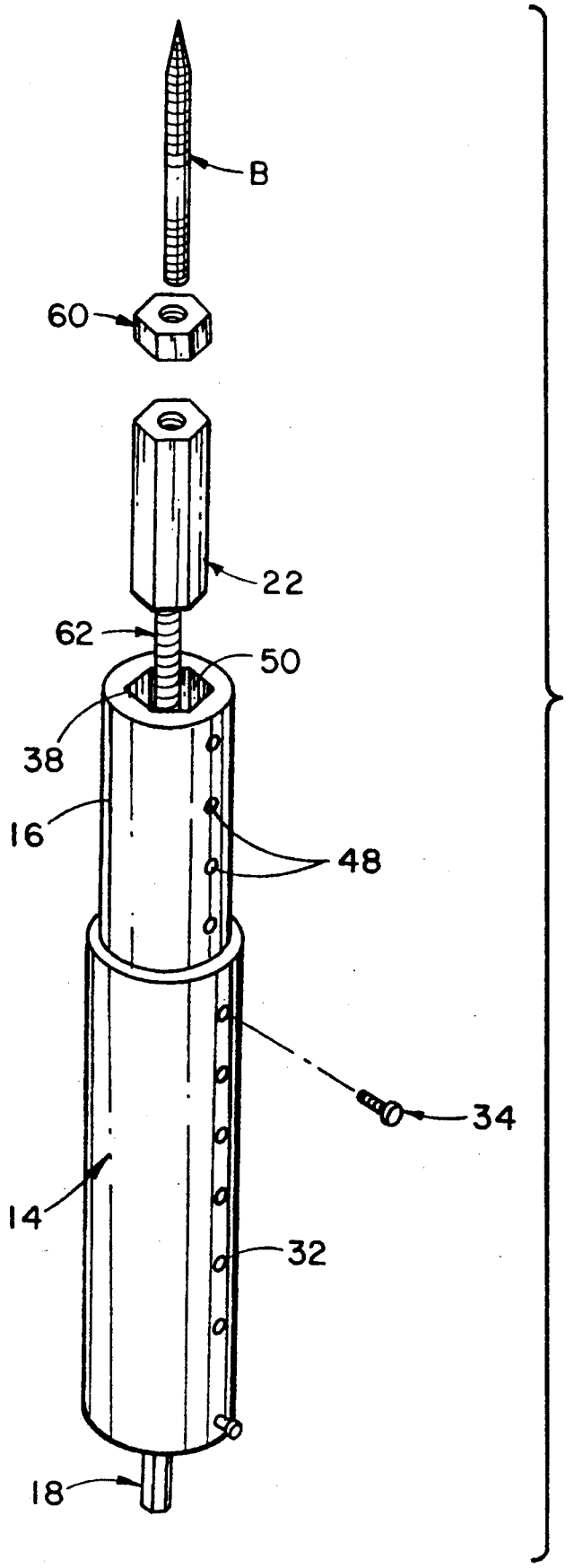
FIG. 8 is an exploded perspective view thereof showing one form of fastener for coupling the telescoping housing sections together and an additional driving tool attaching element.

Many buildings have ceilings that are quite high with respect to the floor. These buildings often include ceiling-mounted elements such as ceiling tiles, sprinkler systems, electrical elements and electrical conduits, water conduits, HAVAC ducting, alarm systems, lighting systems and the like. In the past, installation of such ceiling-mounted elements has required the use of scaffolding or ladders for supporting a worker above the floor. Often, two or more workers must balance on such scaffolding or ladders to install such ceiling-mounted elements. This can be dangerous, especially if the ceiling-mounted elements are to be located in difficult-to-reach positions that may require a worker to work from a contorted position.

The tool embodying the present invention permits a worker to remain on the floor of the building while still facilely manipulating a ceiling-mounted element into position and fixing that element to the ceiling. For the sake of convenience, the ceiling-mounted element discussed herein will be a hanger bolt, such as hanger bolt B shown in FIG. 1. However, it is understood that this element is taken as an example only, and is not intended to be limiting. The tool of the present invention can be used in conjunction with other ceiling-mounted elements, as will occur to those skilled in the art based on the teaching of the present disclosure.

As is shown in FIG. 1–7, a tool 10 includes a telescoping housing section 12 having a plurality of sections, such as sections 14 and 16 included therein. One of the sections, section 14, includes an element 18 on a proximal end 20 thereof and a ceiling-mounted element attaching section 22 on a distal end 24 thereof. The bolt B is releasably attached to the section 22 and is inserted into the building ceiling using the tool 10.

The element 18 is adapted to be attached to a hand-held tool, such as a power drill, or the like, to be rotatably driven thereby and is fixed to the housing section 12 to cause that housing section to rotate in conjunction with the output of the hand-held power tool. The housing section will rotated about the longitudinal axis of the element 18 as indicated by double-headed arrow 23.

Figure 9:
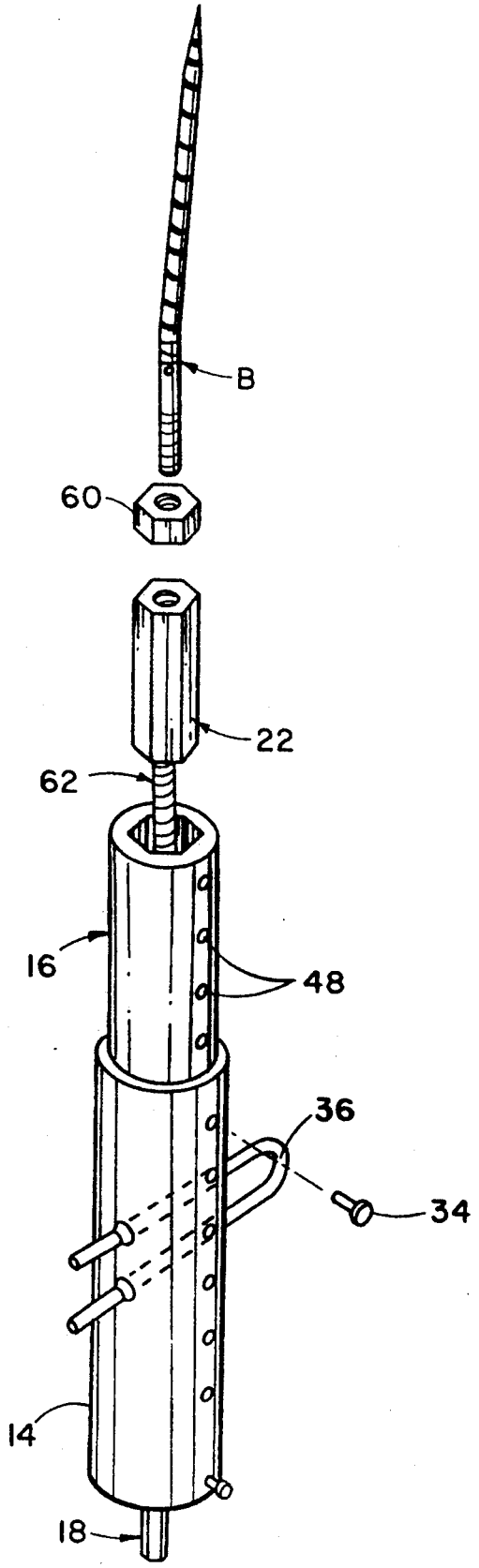
FIG. 9 is an exploded perspective view thereof showing another form of fastener for coupling the telescoping housing sections together.
Figure 10:
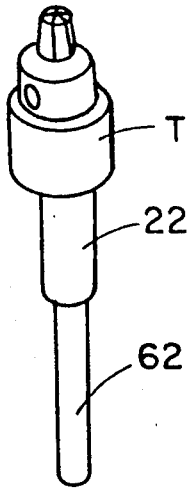
FIG. 10 is an elevational view showing a drill chuck attached to a rod coupling element of the tool.
Figure 11:
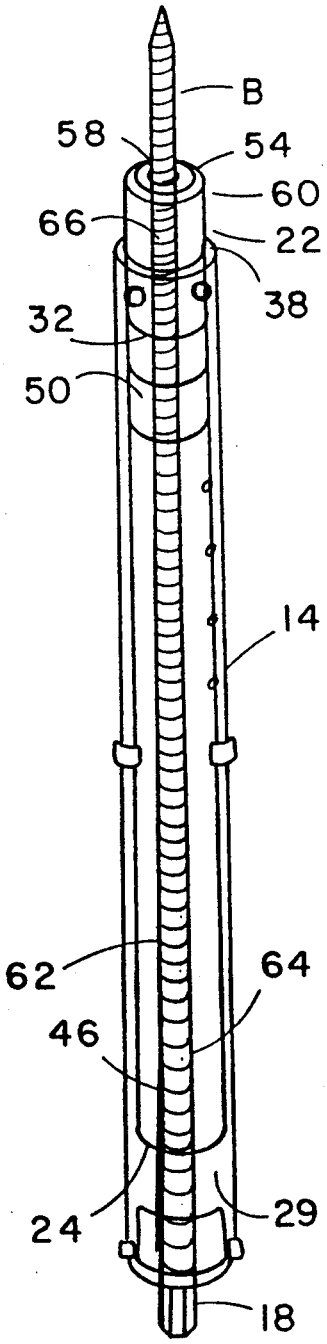
FIG. 11 is a partially cutaway view of the tool.

The housing section 14 is shown in FIGS. 1 and 11, and includes proximal end 20 and a second end 26 that are connected together by a cylindrical wall 28 having a longitudinal axis extending from the end 20 to the end 26 and being linearly aligned with the longitudinal axis of the element 18. The wall 28 is hollow whereby the section 14 includes a central bore 29. The section 14 further includes a plurality of fastener-receiving holes, such as hole 32, defined through the wall 28 at locations that are spaced apart from each other along the longitudinal axis of the section. The section wall 28 is threaded adjacent to each hole to threadably receive threaded fasteners, such as set screw 34 or U-shaped bolt 36 (FIG. 9).

As is shown in FIGS. 1 and 11, housing section 16 includes proximal end 24 and second end 38 and has a longitudinal axis linearly aligned with the longitudinal axis of first section 14. The second section 16 also has a cylindrical wall 40 that is sized and configured to telescope into and out of the first section as indicated by double-headed arrow 42 in FIG. 1.

The section 14 includes a central bore 46 defined along the longitudinal axis thereof from end 24 to end 38 and is threaded adjacent to that bore 46.

The section 16 also has a plurality of fastener-receiving holes, such as hole 48 extending through the wall 40, and is threaded adjacent to each of such holes to threadably receive the fasteners 34 to couple sections 14 and 16 together as shown in FIG. 11.

An end bore 50 is defined in the section 16 to extend from end 38 toward end 24 along the longitudinal axis of that section 16. The end bore 50 is hexagonal in shape and receives the section 22.

The section 22 includes a first end 52 located in the end bore 50 and a second end 54 spaced outwardly of that end bore. In one form of the tool, a stepped wall 56 connects ends 52 and 54. The section 22 includes a longitudinal centerline extending from end 52 to end 54 and is linearly aligned with the longitudinal axes of the housing sections 14 and 16. A bore 58 extends along the longitudinal axis of section 22, and the section 22 is threaded adjacent to that bore 58. The stepped wall 56 includes a plurality of wall sections that are sized to be received in wrenches of various sizes. A preferred form of the section 22 includes a first section 22A that is sized like a 9/16" socket wrence to receive a $\frac{3}{8}$" hexagonal nut, a second section 22B sized like a $\frac{1}{2}$" socket wrench to receive a 5/16" hexagonal nut and a third section 22C sized like a 7/16" socket wrench to receive a $\frac{1}{4}$" hexagonal nut. However, other sizes can be used or included as will occur to those skilled in the art based on the teaching of this disclosure without departing from the scope of the present disclosure.

A further fastener 60, such as a hexagonal nut, includes a threaded bore extending therethrough and is positioned adjacent to end 54 of the section 22. The threaded bore of the fastener 60 is sized and positioned to be a continuation of the threaded bore formed by the aligned bores of the housing sections and the section 22.

As shown in FIG. 11, a threaded rod 62 having an aft end 64 and a fore end 66 is threadably received in the threaded bores of the housing sections and in the threaded bore of the section 22. The section 22 is thus a rod engaging element. In one form of the rod engaging element, the wall thereof is cylindrical, and the other form includes the abovediscussed stepped wall.

The rod hanger bolt B has a thread 70 on an aft end thereof. This thread threadably engages the thread in the rod coupling element 22 and the fastener 60 to couple the bolt to the tool. In another form of the invention, a tool chuck T (FIG. 11) can be mounted on the rod coupling element 22.

In use, the tool is first adjusted for the height of the ceiling to which the element, such as bolt B, is to be mounted. This is achieved by moving housing section 16 with respect to housing section 14, and inserting fasteners 34 into aligned holes 32 and 48. Threaded rod 62 is then rotated to move it into or out of the housing section 12 as required to match the ceiling height. The rod coupling element 22 is threadably mounted on the rod and seated in end bore 50. The fastener 54 is attached to the bolt B, and the bolt is threadably attached to the rod coupling element 22.

The element 18 is secured to a driving end of a power tool, such as a common hand-held power drill, and the bolt B positioned as required on the ceiling. The power drill is then activated, which will rotate the housing and the remainder of the tool about the longitudinal axis thereof in direction 23'. This rotation will drive the bolt into the ceiling. After the bolt is set into the ceiling, the power tool can be set on reverse and activated to rotate in direction 23". This will back the tool off of the bolt by unscrewing the coupling element 22 from the bolt. The bolt will be engaged with the ceiling with a greater degree of frictional fit than with the coupling element 22 so the unscrewing motion will not remove the bolt from the ceiling but will remove the tool from the bolt. If suitable, a hand tool, such as a wrench, or the like, can be used in place of the power tool by engaging that hand tool with the stepped surface 56 of element 22.

Figure 12:
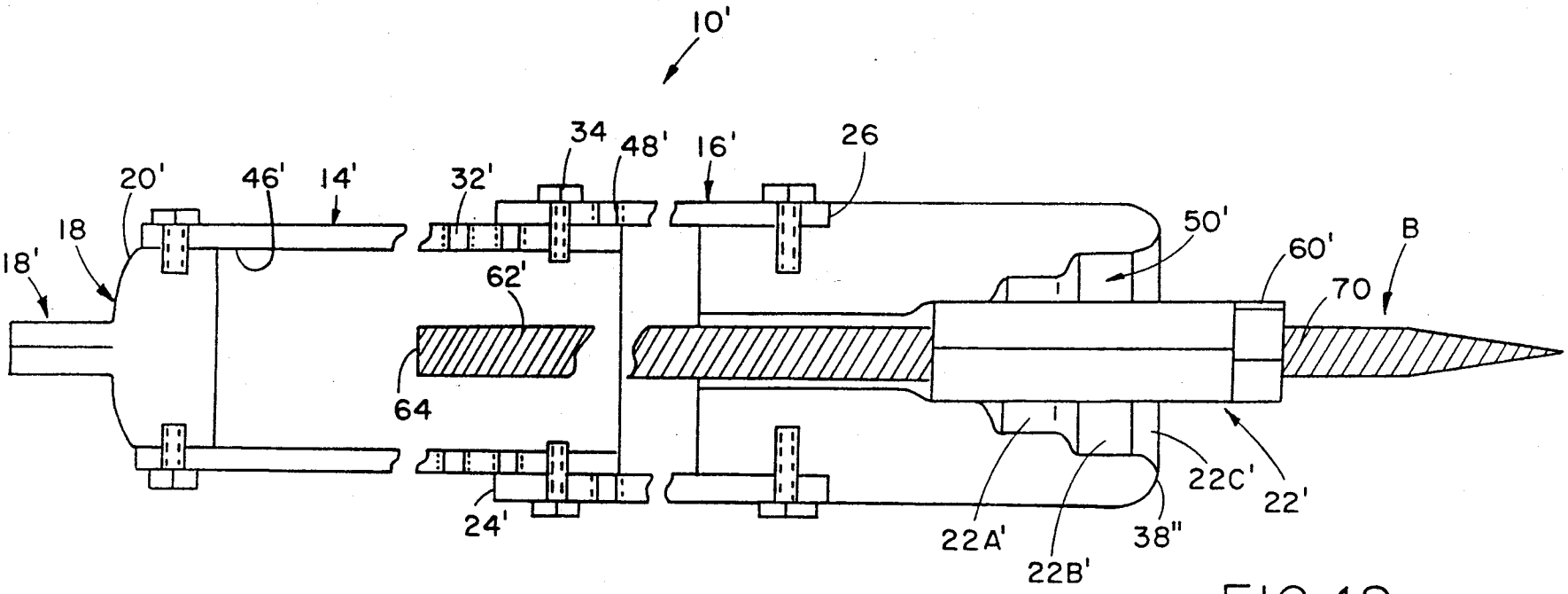
FIG. 12 is a cut away view of one form of the tool.
Figure 13:
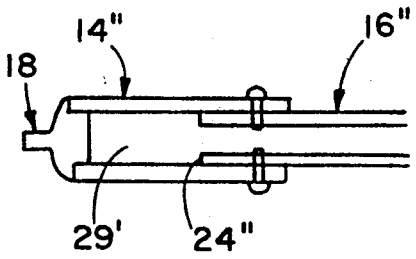
FIG. 13 shows another form of the tool.

Shown in FIG. 12 is one form of the tool 10' in which the element 22 has the sockets located internally thereof. As shown in FIG. 12, the section 16' fits over the section 14'; however, a more preferred form is shown in FIG. 13 where the sectoin 14'' fits over the section 16''. However, either form of the tool is considered as being within the metes and bounds of the present disclosure. The tools shown in FIGS. 12 and 13 are otherwise similar to the tools disclosed above.

Figure 14:
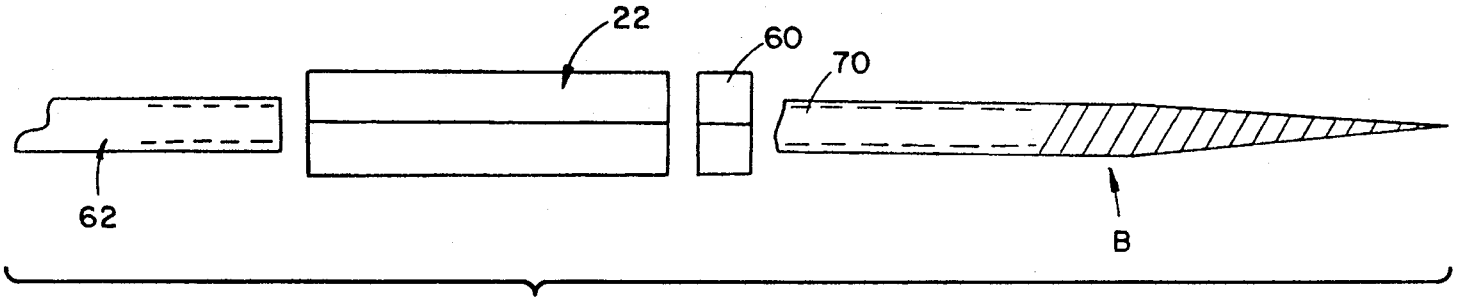
FIG. 14 is an exploded side elevational view of the tool.
Figure 15:
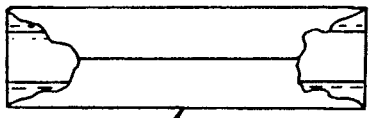
FIG. 15 is a partially cut away view of one element of the tool.

FIG. 14 shows the tool in an exploded perspective view to illustrate the various elements thereof, while FIG. 15 shows the element 22 partially cut away to show the internal screw thread that co-operates with the screw thread on the bolt B.

Figure 16:
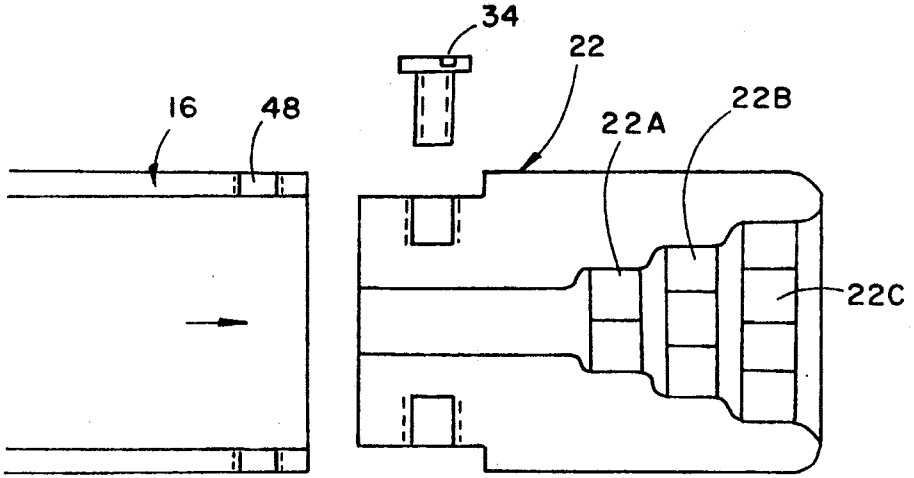
FIG. 16 is an exploded side elevational view of a portion of the tool shown in FIG. 13.

FIG. 16 shows another form of the tool in which element 22'' can be interchanged with other similar elements. The element 22'' shown in FIG. 16 also includes the stepped wall sections discussed above. A fastener 34' is used to releasably mount the element 22'' to the section 16 via a fastener-receiving hole 48. The various socket sizes are indicated in FIG. 16.

It is understood that while certain forms of the present invention have been illustrated and described herein, it is not to be limited to the specific forms or arrangements of parts described and shown.

I claim:

1. A tool for installing ceiling-mounted elements comprising

A) an extendable housing having (1) a first section with a base end, a distal end, a wall connecting said base end to said distal end, said wall being hollow and having a longitudinal axis extending from said base end to said distal end, and a plurality of fastener-receiving holes defined through said wall at locations that are spaced apart from each other along said longitudinal axis, (2) a second section having a first end, a second end, a wall connecting said second section first end to said second section second end, said second section wall being sized to telescope into and out of said first section wall, a longitudinal axis extending between said second section first end and said second section second end and being colinearly aligned with said first section longitudinal axis, a bore extending axially from said second section first end to said second section second end, a screw thread on said second section adjacent to said second section axially extending bore, a plurality of fastener-receiving holes defined through said second section wall at locations that are spaced apart along said second section longitudinal axis, (3) a fastener means sized and configured to be threadably connected to said fastener-receiving holes of said first and second sections to couple said first section to said second section, and (4) an end bore defined in said second section to extend from said second section second end axially of said second section toward said second section first end;

B) a connection element fixed to said first section base end and extending outwardly therefrom along said second section longitudinal axis, said connection element being sized and configured to be drivingly connected to a hand-held power tool;

C) an externally threaded rod threadably connected to said second section axial bore and having a distal end thereof extending outwardly of said second section axial bore;

D) a rod coupling element having a base end located in said end bore, a distal end located outside of said end bore, a longitudinal axis extending from said rod coupling element base end to said rod coupling element distal end, an axial bore defined along said rod coupling element longitudinal axis, a screw thread defined on said rod coupling element adjacent to said rod coupling element axial bore, said rod coupling element axial bore being aligned with said housing second section axial bore and said rod coupling element screw thread forming a continuation of said housing second section screw thread, said threaded rod being threadably received in said aligned rod coupling element and housing second section bores; and E) a threaded fastener located adjacent to said rod coupling element distal end.

2. The tool for installing ceiling-mounted elements defined in claim 1 wherein said rod coupling element further includes a stepped outer surface.

3. The tool for installing ceiling-mounted elements defined in claim 2 wherein said end bore is hexagonal in shape.

4. The tool for installing ceiling-mounted elements defined in claim 3 wherein said fastener means includes a set screw.

5. The tool for installing ceiling-mounted elements defined in claim 4 wherein said fastener means further includes a U-shaped bolt.

6. The tool for installing ceiling-mounted elements defined in claim 5 further including a ceiling hanger bolt having a screw thread on one end thereof that is threadably coupled to said rod coupling element.

7. The tool for installing ceiling-mounted elements defined in claim 5 further including a tool chuck frictionally engaged with said rod coupling element.

8. The tool for installing ceiling-mounted elements defined in claim 1 wherein said connection element includes a first section sized like a 9/16" socket wrench to receive a ⅜" hexagonal nut.

9. The tool for installing ceiling-mounted elements defined in claim 8 wherein said connection element includes a second section sized like a ½" socket wrench to receive a 5/16" hexagonal nut.

10. The tool for installing ceiling-mounted elements defined in claim 9 wherein said connection element includes a third section sized like a 7/16" socket wrench to receive a ¼" hexagonal nut.

11. The tool for installing ceiling-mounted elements defined in claim 10 further including means for releasably mounting said connection element to said second section.

12. The tool for installing ceiling-mounted elements defined in claim 10 wherein said connection element first, second and third sections are located internally of said connection element.

* * * * *